US005461865A

United States Patent [19]

Snyder et al.

[11] Patent Number: 5,461,865

[45] Date of Patent: Oct. 31, 1995

[54] TANGENTIAL ENTRY FUEL NOZZLE

[75] Inventors: Timothy S. Snyder, Glastonbury; Thomas J. Rosfjord, South Windsor; John B. McVey, Glastonbury; Aaron S. Hu, Hartford; Barry C. Schlein, Wethersfield, all of Conn.

[73] Assignee: United Technologies Corporation, Hartford, Conn.

[21] Appl. No.: 201,310

[22] Filed: Feb. 24, 1994

[51] Int. Cl.[6] ..... F23R 3/32

[52] U.S. Cl. ..... 60/737; 60/743; 239/403; 239/470

[58] Field of Search ..... 60/737, 742, 743, 60/748, 39.463; 431/12, 352, 353; 239/400, 403, 432, 434, 470, 504

[56] References Cited

U.S. PATENT DOCUMENTS

| | | | |
|---|---|---|---|
| 4,426,841 | 1/1984 | Cornelius et al. | 60/737 |
| 4,587,809 | 5/1986 | Ohmori et al. | 60/748 |
| 4,653,278 | 3/1987 | Vinson et al. | 60/737 |
| 4,931,012 | 6/1990 | Prudhon | 431/12 |
| 4,932,861 | 6/1990 | Keller et al. | 431/8 |
| 5,000,679 | 3/1991 | Fukuda et al. | 431/353 |
| 5,101,633 | 4/1992 | Keller et al. | 60/748 |
| 5,169,302 | 12/1992 | Keller | 431/173 |
| 5,199,265 | 4/1993 | Borkowicz | 60/737 |
| 5,259,184 | 11/1993 | Borkowicz et al. | 60/742 |
| 5,307,634 | 5/1994 | Hu | 60/737 |

*Primary Examiner*—Timothy S. Thorpe

[57] ABSTRACT

A premix liquid fuel nozzle has longitudinal air entrance slots (24) into a cylindrical chamber (20). A centerbody (42) produces an axially increasing flow area toward the chamber outlet (32). Liquid fuel is atomized in a specified location (58) adjacent the conical centerbody (42). This area has a high axial shear velocity producing thorough vaporization and uniform mixing before combustion.

11 Claims, 2 Drawing Sheets fig. 1
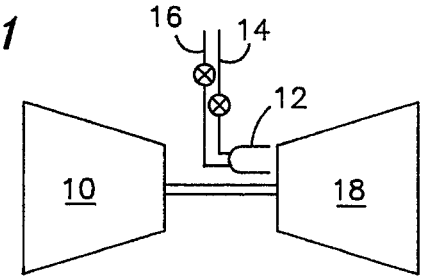
fig. 2
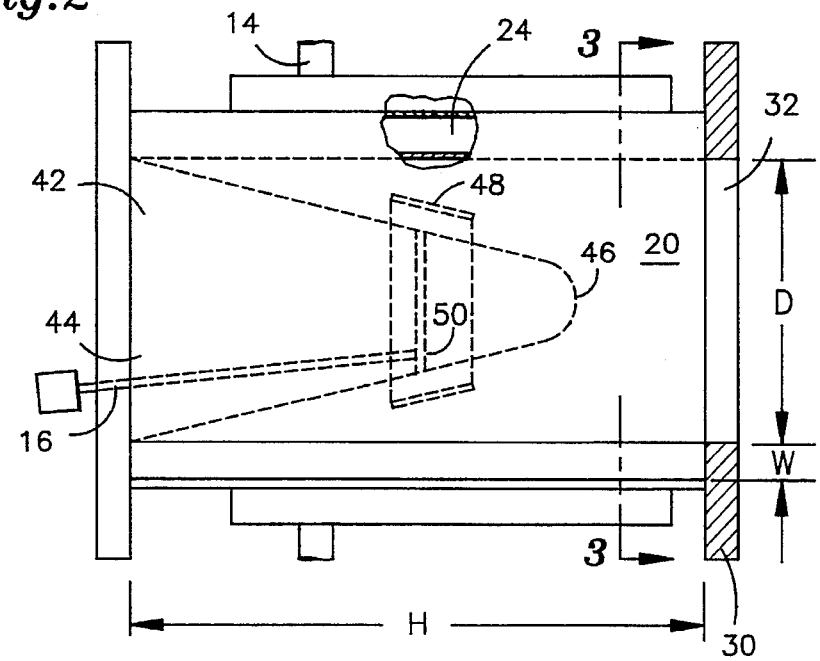
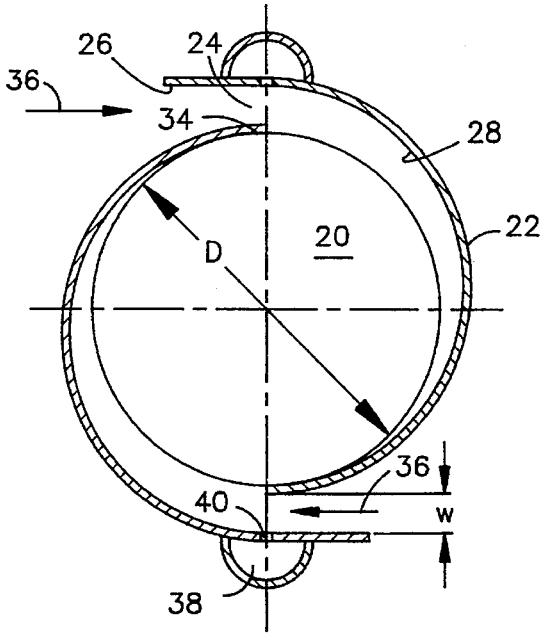
fig. 3

TANGENTIAL ENTRY FUEL NOZZLE

TECHNICAL FIELD

The invention relates to low NOx combustion and in particular to the combustion of liquid fuel

BACKGROUND OF THE INVENTION

Combustion at high temperature leads to the formation of NOx, or oxides of nitrogen, because of the combination of oxygen with nitrogen at high temperature. This is a notorious pollutant and much effort is being put forth to reduce the formation of NOx.

Current gas turbine engines used combustion systems in which the fuel is directly injected into the front end of the combustor. The result on the fuel-air mixture must assure stable efficient combustion. Where no attempt is made to premix these flows, wide variations in the mixture fuel-air ratio exists. Local regions having near stoichiometric fixtures create high temperature combustion products which generate the high NOx levels. In an effort to decrease the combustor emissions of NOx, advanced designs have focused on premixing the fuel and air prior to their introduction into the combustor. In this way both the occurrence of high temperature combustor regions, and the peak temperature within them are minimized. As a consequence, NOx formation is minimized.

Such a strategy is more easily executed for gas fuel devices because a change of phase of the fuel is not required, and the overall fuel-air mixing process can accelerated. With the use of liquid fuel, a high fuel-air ratio inherently exists at the liquid droplet an interface. The strategy must therefore achieve adequate levels of fuel atomization and vaporization simultaneous with fuel distribution and mixing processes. The strategy which relies on fuel-air premixing to suppress peak temperatures is a "dry" NOx control, which is contrast to "wet" NOx control which injects steam or water into the nozzle to suppress flange temperature.

It is desirable that combustion be maintained outside the fuel injector with no flashback or recirculation into the nozzle. The liquid fuel should be vaporized before discharging into the combustor at high power. Where the liquid fuel nozzle is combined with a gas nozzle, the good gas performance of the gas combustion should not be decreased. It is desirable that a uniform mix before ignition be achieved because too rich an area leads to High NOx generation.

SUMMARY OF THE INVENTION

A substantially cylindrical burner chamber is formed of several partial cylinders, each having the axis of the respective cylinder offset from the axis of the others. A slot is formed between the walls of adjacent partial cylinders with this slot having a length and width and the slot wall being tangential to the chamber wall. Combustion supporting air is supplied through this slot.

For a dual fuel nozzle, the gas distribution manifold is located adjacent to slot with the plurality of axially spaced openings for delivering gas to the airflow as it passes into the slot.

A conical body is located in the chamber on the axis of the chamber with the base of the conical body at the upstream end of the chamber and the apex toward the outlet end of the chamber. There is a plenum therefore established between the conical body and the cylindrical chamber.

An injection zone is defined as an annular volume within this plenum concentric with the conical body, bounded by imaginary cones at 30% and 80% of the distance from a conical body surface to the diameter "D", this diameter being a diameter of the outlet of the chamber. It is also defined by planes axially located from the axial center of the inlet slot a distance plus and minus 10% of the inlet slot axial length. There are means for injecting liquid fuel for atomizing within the injection zone.

The liquid fuel may be atomized within the injection zone by locating the splash plate within the zone and directing a flow of liquid fuel against the splash plate. It may be atomized within the injection zone by extending fuel tubes into the zone with a spray nozzle at the end of each tube. The fuel should be atomized to a (sauter) mean diameter of less than 80 microns and preferably about 40 microns particle size.

BRIEF DESCRIPTION OF THE DRAWINGS

FIG. 1 is a schematic of a gas turbine engine and combustor;

FIG. 2 is a sectional axial view of a fuel injector;

FIG. 3 is a sectional view of the fuel injector taken along section 3—3 of FIG. 2;

DESCRIPTION OF THE PREFERRED EMBODIMENT

Figure 4:
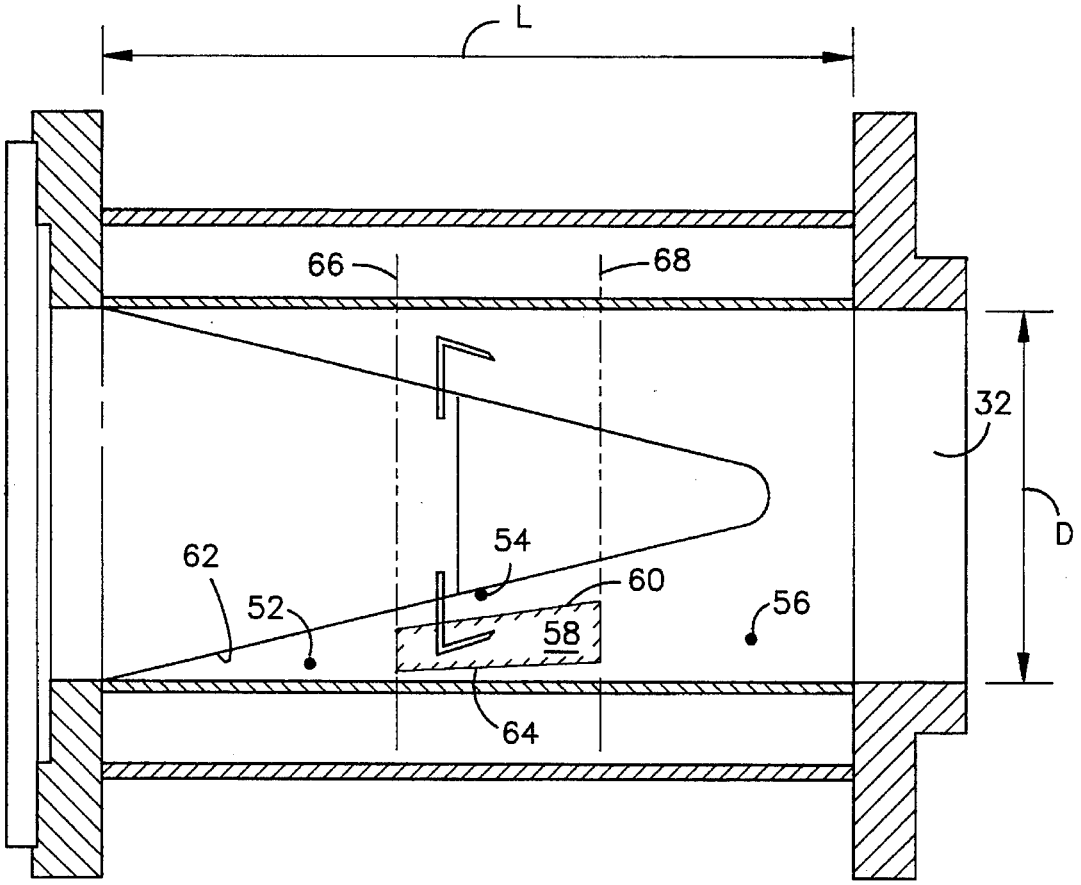
FIG. 4 is a sectional view showing the fuel injection zone.

The FIG. 1 schematic illustrates a gas turbine engine with the compressor supplying compressed air to combustor 12. Gas through gas supply line 14 or oil through oil supply line 16 is supplied to the combustor for combustion. The gaseous combustion products pass through turbine 18.

Referring to FIGS. 2 and 3 a substantially cylindrical combustor chamber 20 is formed by two partial cylinders 22 having their axes offset from one another. Inlet airflow slots 24 are thereby formed having a height "H" and a width "W". These slots are located with the wall 26 of each slot being tangential to the inner wall 28 of the substantially cylindrical chamber. These partial cylinders are secured to a base plate 30 having an opening 32 of diameter "D" for the exit of the air fuel mixture. This diameter is established by a tangent to the inner portion 34 of the partial cylinders and this diameter is relevant to the ratios discussed here below even though the fuel nozzle may be extended with the reduced diameter at the discharge end.

Combustion supporting airflow 36 passes through the slots establishing the whirling action in chamber 20 if gas is supplied as an alternate fuel the gas enters through line 14 to manifold 38 passing through fuel orifice 40. A gas injection nozzle of this sort is described in application Ser. No. 841,942 filed Feb. 26, 1992, now U.S. Pat. No. 5,307, 634.

A conical center body 42 is axially centered in the chamber with its base 44 located at an upstream end and its apex 46 located at the downstream end. While shown and described here as a precise truncated cone, it may have surfaces which are not linear but are parabolic. It has significance in that it modifies the flow area of the incoming air passing through chamber 20 so that the flow area constrains the flow in a manner to produce an average axial velocity which is maintained at a rather uniform level.

A splash plate or splash plates 48 are supported within the chamber 20 by any convenient means with the support having minimum obstruction to the airflow. Liquid fuel through lines 16 is injected through openings 50 and directed against the splash plates 48. Liquid fuel is injected onto the splash plate in a manner which promotes fuel filming over the surface. The swirling airflow shear atomizes the liquid fuel which subsequently vaporizes and mixes with the air.

Tests have been conducted to determine the flow pattern occurring within the combustor chamber and around the conical member. It has been found that fuel introduced at an upstream location 52 or at location 54 near the surface each tends to remain confined to the flow region adjacent to the conical body. This results in a concentration of fuel at the center of the exit plane. On the other hand fuel introduced at a downstream location 56 tends to concentrate around the periphery of the exit plane. Any local concentration of fuel leads to high NOx formation. The desired location of fuel injection would be one which promotes a uniform mixing of the air and fuel at the exit plane where combustion takes place.

These tests have permitted us to define an injection zone 58 at which location the fuel should be atomized. The zone is radially bounded by a first conical imaginary surface 60 located 30% of the distance from the surface 62 of the cone to the surface established by diameter "D". A second imaginary conical surface 64 sets the outside boundary of the radial dimension, this being 80% of the distance between the surface 62 and the diameter "D".

The axial limits of this zone are established by a first plane 66, the location of this plane being related to the length "L" to the inlet slot by being 10% of the length upstream of the midpoint. A downstream plane 68 sets the other boundary this being 20% downstream of the midpoint of the inlet opening.

It has been found that an intense axial shear occurs within this injection zone which promotes mixing and vaporization of the liquid fuel, and which uniformly distributes the fuel in the vaporized form over the exit plane of outlet 32.

The defined injection zone is appropriate for atomization techniques which provide a mean droplet diameter of less than about 80 microns. The vaporization and inertial characteristics of droplets of larger diameter result in fuel being centrifuged to the outer wall, 28, thereby resulting in undesirable rich fuel concentration regions.

Figure 5:
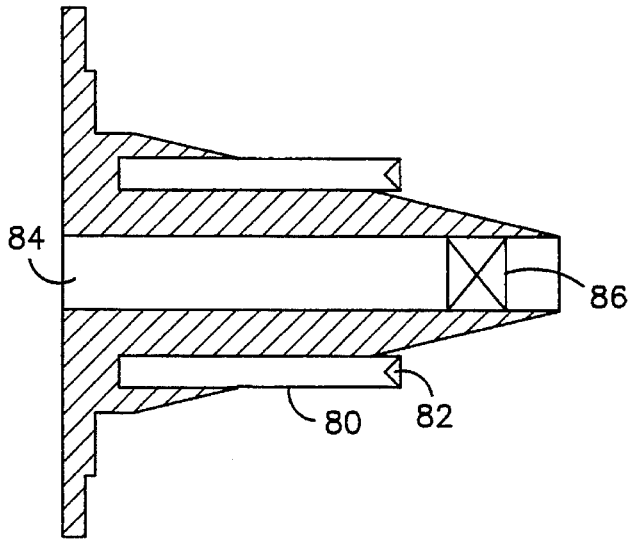
FIG. 5 is a view of an alternate embodiment to that of FIG. 2.

In FIG. 2 a splash plate was shown as a means for atomizing fuel within the injection zone. FIG. 5 shows an alternate where fuel tubes 80 carrying fuel spray nozzles 82 are located within the injection zone.

The central airflow chamber 84, with or without swirling vane 86 may be used in the center of the cone to modulate any recirculation occurring in this swirling flow leaving the fuel nozzle.

We claim:

1. A low NOx burner for a gas turbine engine, comprising:

a substantially cylindrical burner chamber having an axis, having an axially extending chamber wall, and having an upstream end and an outlet end;

said outlet end having a diameter "D";

at least one longitudinally extending slot in the wall of said cylindrical chamber, said slot having an axial length and a slot wall tangential to said chamber wall;

supply means for supplying air through said slot;

a gas distribution manifold located adjacent said slot and having a plurality of axially spaced openings for delivering gas into the airflow as it passes into said slot;

a conical body located in said chamber on the axis of said chamber with the base of said conical body at the upstream end of said chamber and the apex of said conical body toward the outlet end of said chamber;

an injection zone defined as an annular volume concentric with said conical body bounded by imaginary surfaces at 30% and 80% of the distance from said conical body surface to the diameter "D", and by planes axially located from the axial center of said inlet slot a distance 10% toward said base and 20% toward said outlet end of said inlet slot axial length; and liquid fuel injection means for atomizing fuel within said injection zone.

2. A low NOx burner for a gas turbine engine as in claim 1 wherein:

said liquid fuel injection means comprises a splash plate located with at least a portion of said plate within said injection zone; and means for directing a flow of liquid fuel against said splash plate.

3. A low NOx burner for a gas turbine engine as in claim 1 wherein:

said liquid fuel injection means comprises a plurality of imperforate fuel tubes terminating in said injection zone; and a spray nozzle at the end of each fuel tube.

4. A low NOx burner for a gas turbine engine as in claim 1 comprising also:

said substantially cylindrical chamber formed of a plurality of partial cylinders having the axis of each cylinder offset from the axis of the other, whereby a plurality of slots are formed between the walls of adjoining partial cylinders.

5. A low NOx burner for a gas turbine engine as in claim 2 comprising also:

the number of partial cylinders and the number of slots being two.

6. A low NOx burner for a gas turbine engine, comprising:

a substantially cylindrical burner chamber having an axis, having an axially extending chamber wall, and having an upstream end and an outlet end;

said outlet end having a diameter "D";

at least one longitudinally extending slot in the wall of said cylindrical chamber, said slot having an axial length and a slot wall tangential to said chamber wall;

supply means for supplying air through said slot;

a gas distribution manifold for delivering gas into the airflow passing through said slot;

a centerbody located in said chamber on the axis of said chamber in a manner to increase the annular flow area around said centerbody toward said outlet end of said chamber;

an injection zone defined as an annular volume concentric with said centerbody bounded by imaginary surfaces at 30% and 80% of the distance from said centerbody surface to the diameter "D", and by planes axially located from the axial center of said inlet slot a distance 10% toward said base and 20% toward said outlet end of said inlet slot axial length; and liquid fuel injection means for atomizing fuel within said injection zone.

7. A low NOx burner for a gas turbine engine as in claim 6 comprising also:

said substantially cylindrical chamber formed of two partial cylinders, having the axis of each cylinder offset from the axis of the other, whereby two slots are formed between the walls of adjoining partial cylinders.

8. A low NOx burner for a gas turbine engine, comprising:

a substantially cylindrical burner chamber having an axis, having an axially extending chamber wall, and having an upstream end and an outlet end;

said outlet end having a diameter "D";

at least one longitudinally extending slot in the wall of said cylindrical chamber, said slot having an axial length and a slot wall tangential to said chamber wall;

supply means for supplying air through said slot;

a centerbody tapered from a base to an apex, and located in said chamber on the axis of said chamber with the base of said centerbody at the upstream end of said chamber and the apex of said centerbody toward the outlet end of said chamber;

an injection zone defined as an annular volume concentric with said centerbody bounded by imaginary surfaces at 30% and 80% of the distance from said centerbody surface to the diameter "D", and by planes axially located from the axial center of said inlet slot a distance 10% toward said base and 20% toward said outlet end of said inlet slot axial length; and liquid fuel injection means for atomizing fuel within said injection zone.

9. A low NOx burner for a gas turbine engine, comprising:

a substantially cylindrical burner chamber having an axis, having an axially extending chamber wall, and having an upstream end and an outlet end;

said outlet end having a diameter "D";

at least one longitudinally extending slot in the wall of said cylindrical chamber, said slot having an axial length and a slot wall tangential to said chamber wall;

supply means for supplying air through said slot;

a centerbody located in said chamber on the axis of said chamber having a large diameter base of said centerbody at the upstream end of said chamber and having an apex of said centerbody toward the outlet end of said chamber;

an injection zone defined as an annular volume concentric with said centerbody bounded by imaginary surfaces at 30% and 80% of the distance from said centerbody surface to the diameter "D", and near the axial center of said inlet slot;

liquid fuel injection means for atomizing fuel within said injection zone.

10. A low NOx burner for a gas turbine engine as in claim 9 comprising also:

said substantially cylindrical chamber formed of two partial cylinders having the axis of each cylinder offset from the axis of the other, whereby two slots are formed between the walls of adjoining partial cylinders.

11. A method of burning liquid fuel in the combustor of a gas turbine engine with a premixing type of combustion, comprising:

tangentially introducing combustion air through a slot of length "L" into a substantially cylindrical chamber having a centerbody and increasing axial flow area toward an outlet end of said substantially cylindrical chamber having a diameter "D";

distributively atomizing liquid fuel into said combustion air in an injection zone in said substantially cylindrical chamber, said injection zone located from 10% of the length "L" upstream of the center of said slot to 20% of the length "L" downstream, and between 30% and 80% of the distance from said centerbody to said diameter "D"; and burning said main gas flow at the outlet of said substantially cylindrical chamber.

* * * * *